US010359040B2

(12) United States Patent
Leiber et al.

(10) Patent No.: US 10,359,040 B2
(45) Date of Patent: Jul. 23, 2019

(54) CONTROLLER FOR CONTROLLING A FREQUENCY INVERTER AND CONTROL METHOD

(75) Inventors: Wolfgang Leiber, Rielasingen-Worblingen (DE); Martin Hoffmann, Moos (DE)

(73) Assignee: ALLWEILER GMBH, Radolfzell (DE)

( * ) Notice: Subject to any disclaimer, the term of this patent is extended or adjusted under 35 U.S.C. 154(b) by 313 days.

(21) Appl. No.: 14/113,812

(22) PCT Filed: Apr. 26, 2012

(86) PCT No.: PCT/EP2012/057666
§ 371 (c)(1),
(2), (4) Date: Oct. 24, 2013

(87) PCT Pub. No.: WO2012/146663
PCT Pub. Date: Nov. 1, 2012

(65) Prior Publication Data

US 2014/0044561 A1 Feb. 13, 2014

(30) Foreign Application Priority Data

Apr. 29, 2011 (DE) ..... 10 2011 050 017

(51) Int. Cl.

| | |
|---|---|
| ***F04B 49/06*** | (2006.01) |
| ***F04B 49/10*** | (2006.01) |
| ***F04B 49/20*** | (2006.01) |
| ***F04C 2/16*** | (2006.01) |
| ***F04B 17/03*** | (2006.01) |
| ***F04C 14/08*** | (2006.01) |
| ***F04C 14/28*** | (2006.01) |

(52) U.S. Cl.
CPC ..... *F04B 49/065* (2013.01); *F04B 17/03* (2013.01); *F04B 49/103* (2013.01);
(Continued)

(58) Field of Classification Search
CPC ..... F04B 2205/04; F04B 2205/05; F04B 2205/14; F04B 2203/0203;
(Continued)

(56) References Cited

U.S. PATENT DOCUMENTS 4,655,689 A 4/1987 Westveer et al.
5,161,954 A * 11/1992 Matheson ..... F04B 9/105 210/741

(Continued)

FOREIGN PATENT DOCUMENTS

DE 2823558 A1 12/1979
DE 19842565 A1 3/2000

(Continued)

*Primary Examiner* — Philip E Stimpert

(57) ABSTRACT

A controller for controlling a frequency inverter of a positive displacement pump motor of a positive displacement pump. The controller comprises a control unit configured to produce a control variable (Ys) for a frequency inverter of a positive displacement pump motor depending on a reference variable (W) and a first actual operating parameter (X). According to the invention, the control unit is associated with logical means having a first threshold value defining means that are designed to determine at least one first threshold value (YGrenzmax, YGrenzmin) depending on the first actual operating parameter (X) and/or at least one further actual operating parameter (XH, YH, YHH) that could lead to a failure state of the positive displacement pump when exceeded or fallen short of.

22 Claims, 5 Drawing Sheets

(52) U.S. Cl.
CPC ..... *F04B 49/106* (2013.01); *F04B 49/20* (2013.01); *F04C 2/16* (2013.01); *F04C 14/08* (2013.01); *F04C 14/28* (2013.01); *F04B 2203/0204* (2013.01); *F04C 2240/403* (2013.01)

(58) Field of Classification Search
CPC .... F04B 2203/0209; F04C 2/16; F04C 14/08; F04C 14/28; F04C 2240/403
See application file for complete search history.

(56) References Cited

U.S. PATENT DOCUMENTS

| | | | | |
|---|---|---|---|---|
| 5,668,457 | A * | 9/1997 | Motamed | F04B 49/065 318/606 |
| 2002/0001527 | A1 | 1/2002 | Beller et al. | |
| 2003/0206805 | A1 * | 11/2003 | Bishop | F04B 1/0426 417/44.2 |
| 2004/0020225 | A1 * | 2/2004 | Patel | F25B 5/02 62/229 |
| 2005/0029976 | A1 * | 2/2005 | Terry | F04B 35/04 318/400.21 |

FOREIGN PATENT DOCUMENTS

| | | | |
|---|---|---|---|
| DE | 29724347 | U | 11/2000 |
| DE | 102005014050 | A1 | 9/2006 |
| EP | 0701207 | A1 | 3/1996 |
| JP | H05-280070 | A | 10/1993 |
| JP | H05-302574 | A | 11/1993 |
| JP | H09-290763 | A | 11/1997 |
| WO | 2005/050021 | A1 | 6/2005 |

* cited by examiner

CONTROLLER FOR CONTROLLING A FREQUENCY INVERTER AND CONTROL METHOD

CROSS-REFERENCE TO RELATED APPLICATIONS

This is a national stage application of pending international application serial number PCT/EP2012/057666 titled "Controller for Controlling a Frequency Inverter and a Control Method," having an international filing date of Apr. 26, 2012, and which claims priority to German national patent application serial no. 10 2011 050 017.0, filed Apr. 29, 2011, the entirety of which applications are expressly incorporated by reference herein.

FIELD

The invention relates to a positive displacement pump system, and more particularly to a system for regulating or adjusting a drive motor rotational speed for use with a positive displacement pump.

BACKGROUND

Today's positive displacement pump motors for driving positive displacement pumps comprise a frequency converter having an integrated regulator capable of regulating the input signal, in particular a voltage signal for the frequency converter as a function of a measured actual operating parameter and a reference input variable to be achieved. The regulator sends "without criticism" the manipulated variable, which is determined as a function of the reference input variable, to the frequency converter. One problem here is that today, a regulator assigned to a frequency converter is designed only for each specific motor, i.e., it is not optimized with regard to the positive displacement pump, which is actually of interest with positive displacement pump systems. This can lead to problems in the case of positive displacement pump systems because positive displacement pumps are fundamentally a greater threat to the pump itself and/or to other process units in comparison with rotary pumps. This can be attributed to the difference in the characteristic response of positive displacement pumps in comparison with turbo engines. Fundamentally, this may also lead to complete self-destruction or permanent damage to the positive displacement pumps in the extreme case, in particular when signs of damage are not detected promptly.

This also does not take into account the influence of manipulated variable signals, resulting directly from the reference input variable (setpoint input), on the quality of the delivery fluid with known positive displacement pumps.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Starting from the prior art mentioned above, the object of the present invention is to provide controllers specifically for positive displacement pumps for supplying the manipulated variable for the frequency converter of a positive displacement pump motor, such that the controller should minimize the risk of the respective positive displacement pump for itself or other pump units and/or should ensure an optimal product quality, i.e., a delivery fluid of a good quality.

Furthermore, the object is to provide a positive displacement pump system having controllers that have been improved accordingly as well as a control method for controlling a frequency converter of a positive displacement pump motor with which the aforementioned disadvantages can be avoided.

This object is achieved with the features of the claims. All combinations of at least two of the features disclosed in the description, the claims and/or the figures fall within the scope of invention. To avoid repetition, features disclosed pertaining to the device should be considered as having been disclosed according to the process and claimable as such. Likewise, features disclosed pertaining to the process should also be disclosed and claimable as device features.

The invention relates to a controller for controlling a frequency converter of a positive displacement pump motor of a positive displacement pump, in particular a spindle pump, comprising a regulator designed for creating a manipulated variable (manipulated variable signal) for a frequency converter of a positive displacement pump motor as a function of a reference input variable (reference input variable signal) and a first actual operating parameter, where the actual operating parameter, as will be explained further below, preferably measured directly by a sensor or is calculated, in particular being simulated, on the basis of another actual variable. Furthermore, the invention relates to a positive displacement pump system comprising a positive displacement pump, a positive displacement pump motor for driving the positive displacement pump, a frequency converter assigned to the positive displacement pump motor (for regulated or controlled energization of the motor windings) as well as controllers upstream from the frequency converter, designed in accordance with the concept of the present invention, with reference input variable specifying unit provided for the controllers, for example, in the form of a process control room. In addition, the invention relates to a control method for controlling a frequency converter of a positive displacement pump motor of a positive displacement pump according to the preamble of claim 21, wherein a manipulated variable (actuating signal) is generated for the frequency converter of the positive displacement pump motor as a function of a reference input variable and of a first actual parameter.

The present invention is based on the idea that the manipulated variable generated by the regulator as a function of a reference input variable, for example, a setpoint volume flow or a setpoint pressure of the delivery fluid, said manipulated variable preferably being a voltage signal, is not sent directly, i.e., without criticism and/or without a plausibility check, to the frequency converter, i.e., as an input signal to be checked, but instead to compare the manipulated variable or a corrected manipulated variable, which is to be explained below and is obtained from correction means that are optionally provided in addition, in particular second correction means, or according to a functional relationship from the manipulated variable or the corrected manipulated variable or a reference value determined according to a functional relationship from the manipulated variable or from the corrected manipulated variable, comparing it with at least one first limit value (pump protection limit value), such that the at least one first limit value reflects a potential risk for the positive displacement pump and/or another process unit. In other words, going above or below the first limit value would result in a predetermined defect state of the positive displacement pump (with a defined probability). It is essential to the invention here that the first limit value is not a static limit value, i.e., one that is fixedly predetermined and/or defined (where a comparison with such fixed limit values may of course also be performed in addition) but instead is a dynamically determined limit value, which is calculated on the basis of actual operating parameters, where these actual operating parameters are the first actual operating parameters, i.e., an actual controlled variable from the controlled system, on the basis of which the regulator determines the manipulated variable and at least one additional actual operating parameter, i.e., another one, which is either measured directly by means of a sensor or is calculated, in particular being simulated, on the basis of an actual value. To put it yet another way, the advantage of the invention is that it works not only with static limit values but also, according to the invention, takes into account the fact that the limit values are subject to dynamics, i.e., they may change during operation of the positive displacement pump as a function of changing actual operating parameters. For the case when the first (pump protection) limit value thus determined goes beyond the limit values by a certain amount, a corrected manipulated variable is made available with the help of first correction means, the manipulated variable generated by the regulator or a previously corrected manipulated variable generated by two correction means, for example, is preferably overwritten with the help of the first correction means. It is especially expedient if the corrected manipulated variable assumes the maximum or minimum allowed value, i.e., preferably a first currently calculated limit value, to come as close as possible to the reference input variable, or more precisely, the manipulated variable resulting directly from the reference input variable. In other words, the corrected manipulated variable is a capped variable that is capped at the first limit value (preferably a suitably limited voltage signal accordingly).

In addition to the comparison of the manipulated variable, a corrected manipulated variable or a reference value currently ascertained with a first limit value that ensures protection of the positive displacement pump, the manipulated variable ascertained by the regulator as a function of the reference input variable or a corrected manipulated variable (for example, a corrected manipulated variable obtained from the first correction means), in particular the corrected manipulated variable output by the first correction means or a currently calculated reference value is compared with at least one second limit value (delivery fluid protection limit value). Not going beyond this second limit value should ensure the quality of the delivery fluid. In other words, going beyond the second limit value (with a defined probability) can have a negative effect on a predetermined quality parameter of the fluid delivered with the positive displacement pump. Now if the comparator means find that the measured value goes beyond the at least one second limit value (depending on whether it is a maximum limit value or a minimum limit value) by a predetermined amount, then the second correction means will output a corrected manipulated variable, which is preferably sent either directly or indirectly in the form of a comparative value for comparison with the at least one first limit value or as an input variable (setpoint stipulation) to the frequency converter, the manipulated variable generated by the regulator of the manipulated variable obtained by other upstream correction means, for example, the first correction means, is overwritten with the corrected manipulated variable of the second correction means.

It is also important here that the second limit value is not a fixedly predetermined, stored limit value, but instead is a second limit value that is calculated on the basis of actual current operating parameters, such that the actual operating parameter entering into the calculation is the first actual operating parameter, in particular an actual controlled variable and in addition is another (additional) measured actual operating parameter or an actual operating parameter calculated on the basis of an actual value. A comparison of a manipulated variable, a corrected manipulated variable, a comparative value and/or an actual operating parameter with a fixed delivery fluid limit value may of course also be performed using a fixed limit value, and if it goes beyond said limit value, the manipulated variable or the corrected manipulated variable may be corrected.

As already indicated, it is within the scope of the present invention to compare a manipulated variable, a corrected manipulated variable or a comparative value either only with at least one first (pump protection) limit value or only with a second (delivery fluid protection) limit value, or alternatively, to compare it with at least one first (pump protection) limit value and also with at least one second (delivery fluid protection) limit value, whereby again alternatively, the comparison may first be with at least one first limit value and subsequently with at least one second limit value, or conversely, first against a second limit value and then against a first limit value.

The core of the invention is thus to assign a logic unit (logic means) to the regulator for generating a manipulated variable, said logic unit ensuring that the regulator output signal (manipulated variable) is compared first with at least one first limit value and/or at least one second limit value (pump protection limit value and/or delivery fluid protection limit value), such that the at least one first limit value and the at least one second limit value are calculated relevantly, i.e., taking into account measured or calculated actual operating parameters, and in the event that it is detected that the value goes beyond at least one first limit value and/or at least one second limit value, a corrected manipulated variable is generated and then sent as an input signal to the frequency converter (frequency transformer) instead of the manipulated variable originally generated by the regulator or instead of a previously corrected manipulated variable, said frequency converter then energizing the positive displacement pump motor on the basis of this setpoint stipulation.

It is fundamentally possible to implement the logic means in hardware separately from the regulator, for example, in the form of a microcontroller that is separate from the regulator.

An embodiment in which the regulator and the controller are implemented by and/or comprise a shared microcontroller is preferred.

As will also be explained later, it is especially preferred if positive displacement pump-specific parameters, in particular geometry parameters, such as a clearance measure and/or a spindle diameter also enter into the calculation of the at least one first limit value and/or of the at least one second limit value. In this regard, it is especially expedient if multiple data records of system parameters are stored in a (nonvolatile) memory, in particular in an EEPROM, of the logic means, wherein these data records of system parameters are specific for different positive displacement pumps (i.e., each data record is specific for one type of positive displacement pump), in particular for different models and sizes of positive displacement pumps, and it is expedient if it is possible to select in particular in a basic configuration between these data records, for example, by way of a menu control. It is possible in this way to use the same controller in conjunction with different positive displacement pumps.

The controllers designed according to the concept of the present invention make it possible for the first time to detect and optionally counteract possible negative effects in actual changing operating parameters of a reference input variable and/or the effects of a manipulated variable resulting directly from said reference input variable on the intactness of the positive displacement pump and/or on the product quality, i.e., supplying to the frequency converter the quality of the means of the delivery fluid delivered by the positive displacement pump, on the basis of a comparison with a situationally determined limit value, i.e., a limit value that changes over the course of time, and to do so not by converting the manipulated variable (voltage signal) generated by the regulator and resulting directly from the reference input variable by the frequency converter into a positive displacement pump motor rotational speed, as in the past, on detecting a potential threat or by simply turning off the positive displacement pump motor by triggering an electric contactor, but instead by transferring a corrected manipulated variable (preferably larger than zero), which has been increased or reduced in particular as a function of an additional actual operating parameter that is preferably measured. The corrected manipulated variable is preferably the first and/or second limit values calculated by the first and/or second limit value specifying unit, which are provided jointly or alternatively.

The physical variables (parameters) of the pump rotational speed, the delivery fluid viscosity and the delivery fluid pressure are related physically as indicated in the following equation, i.e., are mutually interdependent:

$$n = \left(\frac{p}{k \cdot b \cdot c \cdot v^{a}}\right)^{2}$$

Where n=pump rotational speed p=delivery fluid pressure in the pressure line and/or the delivery fluid pressure difference at the pump, exponent a, factors b and c=constants of the positive displacement pump, k=factor of the delivery fluid lubrication ability, v=delivery fluid viscosity.

According to a preferred exemplary embodiment, it is provided that the controller take into account all the parameters given above for controlling the frequency converter, whereby the pump rotational speed is preferably taken into account in the form of the manipulated variable, the delivery pressure is preferably measured on or near the pressure connection or, alternatively, is calculated from additional parameters as the first actual operating parameter, and a delivery fluid viscosity or a parameter, in particular a fluid parameter with which the delivery fluid viscosity is in a physical relationship, in particular the delivery fluid temperature as the second operating parameter, whereby the aforementioned first actual operating parameter, i.e., the delivery fluid pressure and the additional actual operating parameter, preferably the delivery fluid viscosity or the delivery fluid temperature, are taken into account by means of the first limit value specifying unit to calculate the first limit value, which when exceeded or when not met could result in a defect condition of the positive displacement pump. The comparator means then compare the manipulated variable output by the regulator, i.e., a rotational speed signal, with the first limit value, such that the first correction means output a corrected manipulated variable, i.e., a corrected rotational speed signal for the case when the manipulated variable output by the regulator goes beyond the parameter, which is in a functional relationship thereto, taking into account the delivery fluid pressure and the delivery fluid viscosity, such that the corrected manipulated variable, i.e., the corrected rotational speed signal, is preferably the first limit value calculated previously with the help of the first limit value specifying unit. In this preferred embodiment, a delivery fluid volume flow (and/or the pump rotational speed, which reflects the delivery volume flow) or a delivery fluid pressure is used as the reference input variable.

This preferred embodiment is taken into account in the case, which often occurs in practice, namely when a rapid change in a disturbance variable, e.g., a sudden change in flow resistance, leads to a very rapid change in pressure and thus to a rapid change in the torque demand on the pump. In the case of a rapid drop in pressure with a large pump drive, this would lead to a rapid increase in the rotational speed. An unacceptable increase in rotational speed can be prevented by taking into account the delivery fluid pressure, preferably measured at the pressure connection, as the first operating parameter and directly or indirectly taking into account the delivery fluid viscosity as a second operating parameter in calculating the first limit value, so that damage to the pump can be prevented.

With small drive motors, a very rapid and sudden increase in pressure would lead to a rapid reduction in rotational speed, so that here again, taking into account the initial operating parameters mentioned above and the additional operating parameters mentioned above would lead to a corrected manipulated variable, i.e., a corrected rotational speed signal, so that damage to the pump can also be prevented in this case.

In the event of implementation of protection of the medium, the delivery fluid pressure, the delivery fluid volume flow and/or the rotational speed may be considered as the reference input variable or the delivery fluid viscosity and/or a parameter, in particular a fluid parameter, on which the delivery fluid viscosity depends directly is taken into account. The manipulated variable is preferably the rotational speed and/or a rotational speed signal, such that a maximum allowed rotational speed is preferably taken into account to calculate the limit value in particular, preferably a delivery fluid volume flow as the first operating parameter, and the delivery fluid pressure is also taken into account as the additional actual operating parameter (measured at the pressure connection of the pump in particular).

As already mentioned, the comparison with the at least one limit value may be performed in various ways. Thus it is especially preferred if the manipulated variable generated by the regulator is used for comparison with the first limit value, or as an alternative, the corrected manipulated variable output by the first correction means or the corrected manipulated variable output by additional correction means, for example, second correction means that are optionally present. It is also possible not to use the aforementioned manipulated variable or a corrected manipulated variable directly for the comparison, but instead to use a comparative value calculated on the basis of a predetermined functional relationship from the manipulated variable or a corrected manipulated variable. Similarly, it is also possible to use the manipulated variable generated by the regulator for the comparison with the second limit value or to use a corrected manipulated variable, in which case the corrected manipulated variable may be the corrected manipulated variable output by the first correction means, if said corrected manipulated variable is used, or it may be the corrected manipulated variable output by the second correction means. It is likewise possible to calculate a comparative value, e.g., a current shear rate based on one of the aforementioned values, and to use it for the comparison.

As mentioned previously, the logic means may compare the manipulated variable generated by the regulator, a corrected manipulated variable or a comparative value calculated on the basis of the manipulated variable and/or the corrected manipulated variable or compare an actual operating parameter, in particular the first operating parameter and/or the additional actual operating parameter, with at least one specific fixed limit value for the positive displacement pump assigned to the controller, such that, for the case when the result goes beyond such a limit value by a certain amount, a corrected manipulated variable is output by the correction means. If the actual operating parameter to be compared is a measured actual vibration value, for example, and if the latter exceeds a maximum amount for the specific positive displacement pump (limit value), then a corrected manipulated variable is output by the correction means, such that this manipulated variable correction may be placed before or after a possible correction by first correction means and/or by second correction means. In the simplest case, the corrected manipulated variable is a manipulated variable signal that has been increased or reduced by a certain factor or it is a manipulated variable signal that assumes a value stored in a memory or it may be a simulated calculated value which is not expected to be above or below the limit value.

The embodiment of the controller described last serves mainly to detect a sudden damage or a sign of sudden damage to the positive displacement pump. For example, if a vibration parameter is monitored by sensor means as a measured actual operating parameter, and if this value exceeds a limit value, which is stored in a nonvolatile memory or is preferably determined alternatively or additionally as a function of an additional measured or calculated actual parameter, then it is not the manipulated variable which corresponds to the reference input variable that is forwarded but instead a calculated manipulated variable which is reduced by a factor of 2, for example, in order to be able to operate the positive displacement pump as long as possible without any damage, for example, bearing damage, occurring or exacerbating, for which the increased vibration value might be an indicator.

There are various possibilities with regard to the specific embodiment of the regulator of the controller preferably formed by a microcontroller. The regulator is preferably embodied as a PI regulator or as a PID regulator.

There are different possibilities with regard to the choice and/or embodiment of the first actual operating parameter, which is sent to the regulator for ascertaining a manipulated variable, and on the basis of which the first (pump protection) limit value and/or the second (delivery fluid protection) limit value is optionally calculated, and which is optionally used for calculation of the corrected manipulated variable by the correction means. The first actual operating parameter is preferably an actual controlled variable, preferably measured, from the controlled system, in particular a so-called actual main controlled variable, for example, an actual pressure of the delivery fluid or an actual pressure difference of the delivery fluid, for example, between the suction side and the pressure side of the positive displacement pump, or it is an actual volume flow of the delivery fluid. The first operating parameter is preferably measured, but as an alternative, it may also be simulated or calculated, in particular from a plurality of additional actual operating parameters.

As already explained in the introduction, the first and/or second limit value(s) must be calculated not only on the basis of the first actual operating parameter supplied to the regulator but also on the basis of the functional relationship based on another additional actual operating parameter. The at least one additional actual operating parameter may be a measured auxiliary manipulated variable of the frequency converter in particular, or one calculated on the basis of an actual value that is measured, for example, for example, a rotational frequency setpoint value of the frequency converter or a torque setpoint value of the frequency converter. It is also possible that at least one additional actual operating parameter is a measured auxiliary controlled variable or one calculated on the basis of an actual value, in particular a rotational speed of the positive displacement pump motor or a torque of the positive displacement pump motor. It is possible that at least one additional actual operating parameter, which enters into the calculation of the first and/or second limit value and/or enters into the calculation of a corrected manipulated variable and/or into the calculation of a comparative value, may be a measured temperature, for example, a delivery fluid temperature or a storage temperature, in particular of a roller bearing of a drive spindle of the positive displacement pump. It is also possible that the at least one additional actual operating parameter is a measured vibration value. It is also possible that the at least one additional actual operating parameter is a measured or calculated delivery fluid viscosity. It is also possible that the at least one additional actual operating parameter is a measured leakage quantity. It is especially preferred if not only the first actual operating parameter and only a single additional actual operating parameter are taken into account in the calculation of a limit value or a corrected manipulated variable but instead, for example, two or more additional actual operating parameters, preferably different parameters, are taken into account in addition to the first operating parameter.

For medium protection applications (preferably not for pump protection applications), the at least one additional operating parameter may be a measured actual controlled variable, for example, a measured actual main controlled variable, for example, an actual pressure of the delivery fluid, an actual pressure difference or an actual volume flow.

If the pressure at the suction connection is too low, it may serve as a cavitation indicator. The delivery fluid viscosity may be taken into account as an operating parameter, preferably in addition to the pressure, where the delivery fluid viscosity in particular is representative of the viscosity of the delivery fluid, in particular its measured temperature, for reasons pertaining to the measurement technology.

The temperature may thus be monitored as an actual operating parameter in addition to or as an alternative to a pressure. An excess temperature of the delivery fluid may be a threat to the pump, in particular with regard to possible bearing damage.

The motor rotational speed may be taken into account as an actual operating parameter in the limit value calculation and/or in the calculation of a corrected manipulated variable, in addition or as an alternative to the pressure according to a fixed assignment and/or function which is directly proportional to the rotational speed of the positive displacement pump (spindle rotational speed), in particular corresponding to it. If the rotational speed is too high or too low, this may also constitute a risk, in particular when additional operating parameters, such as the temperature and/or the pressure, for example, go beyond certain limits.

Vibration of the positive displacement pump and/or of the positive displacement pump motor may also be monitored in addition or as an alternative to the actual operating parameters mentioned above. Excessive vibration threatens the alignment between the positive displacement pump and the positive displacement pump motor, with the possible result being bearing damage to the positive displacement pump and/or to the positive displacement pump motor. Damage to bearing ring seals due to an unacceptable vibration is also possible. On the whole, the lifetime of positive displacement pumps can be reduced due to unacceptable vibration, in particular when additional actual operating parameters, such as the rotational speed and/or the temperature and or the pressure, exceed go beyond certain limits.

In addition or as an alternative to the additional operating parameters mentioned above, the viscosity of the delivery fluid, which is functionally related to the temperature of the delivery fluid may also be taken into account directly or indirectly via the temperature in the determination of a limit value, a corrected manipulated variable or a comparative value, if any is provided. If the viscosity is too low, it may damage the positive displacement pump because of the resulting decline in lubrication properties of the delivery fluid between the spindles. If the viscosity is too high, that may also endanger the positive displacement pump so that the torque increases too much. Furthermore, it may also endanger the positive displacement pump for the viscosity to be too high (temperature too low), for example, when using a magnetic coupling which may break away without being noticed if the viscosity is too high, often leading to the destruction of the positive displacement pump and/or the magnetic coupling.

In addition to the actual operating parameters mentioned above, which are measured individually, in groups or preferably jointly to ensure protection of components (protection of positive displacement pump) or to ensure and/or guarantee the quality of the delivery fluid and then these parameters are taken into account in the calculations according to a mathematical function, at least one of the actual operating parameters described below may be monitored, for example, the torque which is functionally dependent on the viscosity of the delivery fluid. In particular the torque may be taken into account as an indicator of an increase in the positive displacement pump wear.

In addition or alternatively, the positive displacement pump motor current may also enter into the calculation of a limit value, a corrected manipulated variable or a comparative value, if any. The motor current is a variable, which is simple and inexpensive to measure, in particular when other parameters remain the same such as, for example, the viscosity for the torque, which may in turn be an indication of wear on the pump. In addition or alternatively, the leakage rate may also be monitored. This is based on the idea that each bearing ring seal requires a nominal leakage, so that the static and dynamic components of the bearing ring seal are lubricated. If the leakage rate increases, this may be an indicator of incipient bearing ring seal damage.

If the manipulated variable generated by the regulator is not to be compared directly, although that is preferred, with a first or second limit value, or if the same statement applies to the manipulated variable corrected by correction means, but instead to a comparative value, which is functionally related to the manipulated variable or the corrected manipulated variable, in addition or as an alternative for this comparison, then several of these comparative values may enter into the calculation on the basis of a functional relationship of several of the aforementioned actual operating parameters, in particular the first actual operating parameter and at least one of the additional actual operating parameters.

It is especially preferable if the first and/or second limit value specifying unit and/or the first or second correction means take into account in their calculations such positive displacement pump-specific geometry parameters as the gap width and/or the spindle diameter when said geometry parameters are assigned to the controllers. In addition or alternatively, the limit value specifying unit and/or the correction means may be designed to take into account a delivery fluid parameter stored in a memory, in particular a shearing behavior of the delivery fluid.

It is thus advantageous in particular with regard to monitoring the quality of the delivery fluid or of the end product produced with it to take into account the angular velocities of the positive displacement pump spindle in the calculation of a limit value, of a corrected manipulated variable or of a comparative value, if any is provided, in the calculation. Preferably at least one geometry parameter and the angle of slope of the respective spindle should be taken into account because different angles of slope of the spindle can lead to different relative velocities within the positive displacement pump at the same rotational speed of the motor.

A variant in which the at least one measured actual parameter, for example, the first actual operating parameter or an additional actual parameter is not supplied directly by the sensor means to the controller but instead at least one actual operating parameter is transmitted to the controller from a process control room, in particular over a bus system, as described in greater detail below.

It is especially preferred when a shear rate is taken into account in the calculation of the at least one first and/or at least one second limit value, in particular a maximum allowed shear rate stored in a memory and/or a shear rate calculated currently on the basis of at least one actual operating parameter is taken into account according to a functional relationship.

As already explained, it is conceivable that, in addition to a dynamic limit value consideration, there is also a static limit value consideration in which the manipulated variable, a corrected manipulated variable, a comparative value or directly a first operating parameter and/or another operating parameter is/are compared with a limit value stored in a memory, preferably not a volatile memory, of the logic means and, if the limit value should exceed a predetermined measure or fail to meet a predetermined standard, a corrected manipulated variable is determined and output so as not to threaten the pump or the product quality. In the simplest case, the manipulated variable provided for this purpose by the regulator or the manipulated variable already corrected on the basis of a previous comparison may be increased or decreased by a predefined amount, in particular a predefined factor.

In addition or as an alternative to at least one measured and one first actual operating parameter and/or in addition or as an alternative to a measured or calculated additional actual operating parameter and/or at least one predefined positive displacement pump-specific geometry parameter, the first and/or second limit value specifying unit and/or the first and/or second correction means may be designed to take into account a delivery fluid parameter (fluid-specific property value/constant) according to a mathematical function or allocation in the calculation of the corresponding limit value or of the corrected and manipulated variable, this value being stored in a nonvolatile memory of the controller, for example. It is preferably possible to select either manually or automatically among various fluid parameter data records, for example, as a function of a measurement result. The shear ratio of the delivery fluid is preferably taken into account as the delivery fluid parameter, in particular when a shear rate is used to determine a limit value or a corrected manipulated variable.

It is most especially expedient if the logic means is designed for determining and/or signaling a need for maintenance on the positive displacement pump as a function of a measured or calculated actual operating parameter and/or as a function of a positive displacement pump-specific parameter assigned to the controller. The logic means therefore preferably include a corresponding function unit which is designed to take into account the measured or calculated actual parameter and/or the positive displacement pump-specific parameters in determining the need for maintenance. This function unit preferably calculates the need for maintenance on the basis of a predetermined (functional) assignment. The need for maintenance is preferably signaled via corresponding signaling means, for example, a display and/or an LED lamp, which may emit different color signals.

It is especially expedient if the first and/or second correction means are designed so that a stop signal is emitted for the positive displacement pump motor, in particular for a motor contactor, in the case when the limit value is exceeded by a predetermined value, in particular by a value that is very high or very low and/or if it fails to meet the set value, in particular to prevent further damage to the positive displacement pump or additional process systems or to the quality of the delivery fluid.

In a refinement of the present invention, it is advantageously provided that the controller are designed to communicate via a bus system, in particular a CAN bus system, in particular to be able to communicate with other positive displacement pump controllers and/or a process control room, i.e., to be able to transmit and/or receive data. It is especially expedient if a CAN bus system, as is known primarily from automotive engineering, is assigned in the control module, in particular for communication with the control room and/or at least one additional module. It has surprisingly been found that such a bus system is especially reliable and sturdy in conjunction with positive displacement pump systems.

It is especially expedient if input means, in particular in the form of a key, preferably in the form of multiple keys and/or a touchscreen, etc., is/are assigned to the controller in order to be able to configure and/or read out the controller. One of many system parameter data records and/or delivery fluid parameter data records stored in a nonvolatile memory may be selected via the input means.

Most especially expedient is an embodiment of the controller in which the controllers have memory means designed and controlled to store received, calculated and/or transmitted data, in particular measured values or voltage characteristics, in particular to also log them. The memory means are especially preferably designed and controlled to save measured actual operating parameters and/or reference input variables and/or manipulated variables and/or corrected manipulated variables.

The invention also relates to a positive displacement pump system, comprising a positive displacement pump, a positive displacement pump motor, preferably embodied as an electric motor, and the controllers designed as described above and assigned to the positive displacement pumps for generating a manipulated variable, optionally corrected, in particular a voltage signal for the frequency converter of the positive displacement pump motor, also included in the system. Reference input variable specifying unit are assigned to the controllers, supplying the controllers with the input reference variables, for example, a setpoint volume flow, a setpoint pressure, etc., preferably in the form of a voltage signal. The function of the reference input variable specifying unit may be taken over in particular by a process control room, which, if present, is designed to monitor and/or control and/or regulate additional process equipment, such as additional positive displacement pumps, in addition to the positive displacement pump assigned to the controllers. In addition or as an alternative to a process control room, the reference input variable may be preselected manually, for example, through a corresponding setting of the controllers, and then generated by the controllers per se and/or generated by a simple voltage source that is separate from the controllers, outputting an electric voltage value as the reference input variable.

It is especially expedient if the controllers are designed to communicate with the process control room and/or with additional controllers over a bus system, in particular a CAN bus system, wherein measured actual operating parameters, for example, can be transmitted over this bus system and can be stored in one of several controllers.

The system preferably also comprises at least one sensor (sensor means), preferably at least two sensors, which have a signal-conducting connection with the control means, such that the sensor(s) is/are designed and arranged for measuring the first actual operating signal and optionally at least one additional actual operating signal. For example, these may include a pressure sensor for determining a fluid pressure, in particular a differential pressure and/or a temperature, for example, a delivery fluid temperature or a storage temperature. This may also be a rotational speed meter for determining the rotational speed of the positive displacement pump and/or a torque meter for detecting the torque of the positive displacement pump motor and/or a vibration sensor for measuring a vibration value and/or a fluid viscosity meter for determining the fluid viscosity and/or a leakage rate meter and/or a volume flow meter. It is especially expedient if the control means have a signal-conducting connection to the frequency converter in order to receive an actual auxiliary manipulated variable as the first and/or at least one additional actual operating parameter, in particular a rotational frequency setpoint value or a torque setpoint value from the frequency converter.

Furthermore, the invention also relates to a control method for controlling a frequency converter, wherein the method and/or an advantageous embodiment of the method has/have already been described on the basis of preferred controllers.

BRIEF DESCRIPTION OF THE DRAWINGS

Additional advantages and details of the invention are derived from the following description of preferred exemplary embodiments and the drawings, which show.

DETAILED DESCRIPTION

Figure 1:
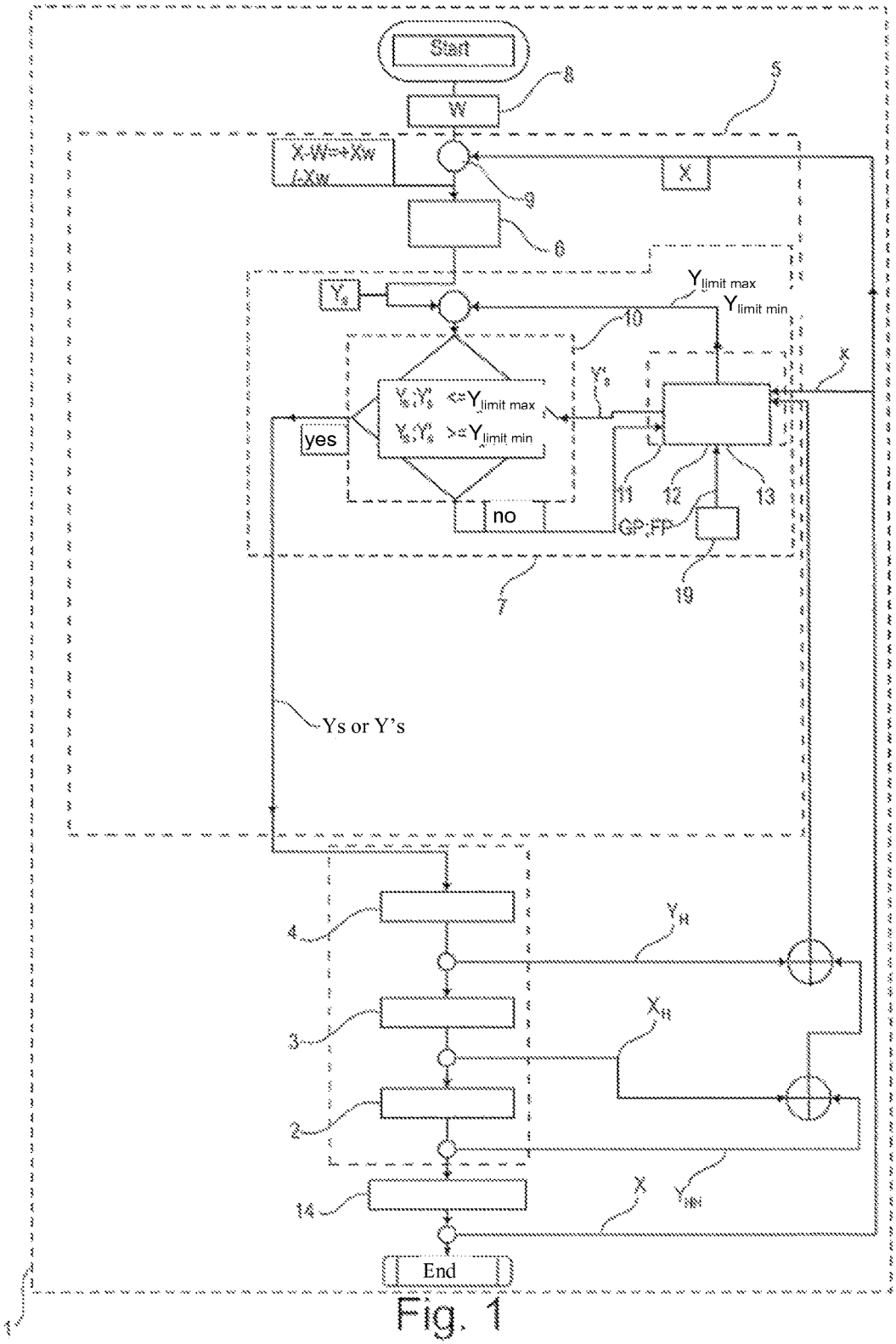
FIG. 1 is an embodiment of a controller configured to compare a manipulated variable generated by a regulator with a first (pump protection) limit value.

The present embodiments will now be described more fully hereinafter with reference to the accompanying drawings, in which some embodiments are shown. The subject matter of the present disclosure, however, may be embodied in many different forms and should not be construed as limited to the embodiments set forth herein. Rather, these embodiments are provided so that this disclosure will be thorough and complete, and will fully convey the scope of the subject matter to those skilled in the art. In the drawings, like numbers refer to like elements throughout.

In the figures, the same elements and elements having the same function are all labeled with the same reference numerals.

Exemplary Embodiment According to FIG. 1

FIG. 1 shows schematically the design of a positive displacement pump system 1, which comprises a positive displacement pump 2, designed as a single-spindle pump or as a multi-spindle pump, in particular a triple-spindle pump in the embodiment shown here. The positive displacement pump 2 is operatively connected to a motor shaft of a positive displacement pump motor 3, designed as an electric motor comprising a frequency converter 4, which controls and/or regulates the flow of electricity to the motor windings of the positive displacement motor pump 3 as a function of a manipulated variable $Y_S$ generated by the regulator 6 or a corrected manipulated variable $Y'_S$ or a manipulated variable $Y'_S$, optionally been corrected multiple times.

To generate the manipulated variable YS or a corrected manipulated variable Y'S, the positive displacement pump system 1 comprises a controller 5 formed by a microcontroller, for example, including a regulator 6, as mentioned above, as well logic means 7.

Reference input variable specifying unit 8, for example, a process-controlled panel supplying reference input variables W to the controllers 5, are provided upstream from the controllers 5, where the reference input variable supplied is an electric voltage signal representing a setpoint volume flow or a setpoint pressure, for example.

The reference input variable W and a first actual operating parameter X supplied from the outside are sent to the regulator 6, more specifically to a subtracter 9 of the regulator 6 which calculates the difference X−W. The actual regulator 6, which is embodied as PI regulator or a PID regulator, for example, thus determines a manipulated variable YS, on the basis of the reference input variable W and the first actual operating parameter X, which is measured here. This manipulated variable YS, is not sent directly to the frequency converter 4, as in the state of the art, but instead first passes through the logic means 7, comprising first comparator means 10 in the exemplary embodiment shown here. The comparator means compare the manipulated variable YS generated by the regulator 6 with at least one first limit value, preferably a maximum first limit value Ylimit max to be maintained and/or a minimum limit value Ylimit min to be maintained. Instead of the direct comparison of the manipulated variable YS with the at least one first limit value, a comparative value that is functionally related to the manipulated variable YS may be calculated with the help of (optional) comparative value specifying unit (not shown here) on the basis of the manipulated variable YS, such that at least one actual operating parameter, for example, the first actual operating parameter X, and at least one additional actual operating parameter to be explained in greater detail below, may also enter into the calculation of same according to a functional relationship. The comparative value specifying unit may also take into account a geometry parameter of the positive displacement pump and/or a delivery fluid parameter according to a functional relationship for calculation of the comparative value, said parameter(s) then also having to be taken into account further in taking into account the limit value. In the exemplary embodiment shown here, this additional comparative value calculation step is eliminated, however, and the manipulated variable YS is compared directly with at least one first limit value Ylimit max and/or Ylimit min, such that the at least one first limit value is a positive displacement pump protection limit value which when exceeded or not met will or could result in a defect in the positive displacement pump.

A first function unit 11 is assigned to the comparator means 10, including an addition to first limit value specifying unit 12, first correction means 13. The function unit 11 calculates the at least one first limit value Ylimit max, Ylimit min, which is sent to the comparator means 10 in addition to the manipulated variable YS generated by the regulator 6. The comparator means then check on whether the manipulated variable YS drops below a maximum first limit value Ylimit max and/or whether the manipulated variable YS exceeds a minimum first limit value Ylimit min. If this is the case, then the manipulated variable YS is an allowed manipulated variable, which does not pose a threat for the positive displacement pump and can be supplied for additional comparisons and correction routines that are not shown here or may be sent directly, as shown here, as an input signal to the frequency converter 4 which then triggers the positive displacement pump motor 3 on this basis.

To calculate the at least one first limit value, the first actual operating parameter X is sent to the first function unit 11, and another measured or calculated actual operating parameter YH and/or XH is also sent to the function unit, such that the actual operating parameter YH in the exemplary embodiment shown here is an auxiliary manipulated variable of the frequency converter, for example, a rotational frequency setpoint value or a torque setpoint value of the frequency converter. These are not measured values but instead are values that are calculated, in particular simulated, based on at least one actual parameter, for example, based on a current control measurement calculated by the frequency converter. The additional actual operating parameter XH in the exemplary embodiment shown here is an auxiliary controlled variable, for example, a motor rotational speed and/or a positive displacement pump rotational speed or a torque, which is preferably measured directly on the motor 3. Thus, in each case, an operating parameter, for example, the first actual operating parameter, namely here the actual value of the controlled variable from the process control system 14, is taken into account by the first limit value specifying unit 12 for calculating the at least one pump protection limit value, and at least one additional actual operating parameter YH, XH or one main manipulated variable YHH, preferably a measured variable for the process controlled variable X, for example, a pressure or a volume flow is also taken into account.

For the case when the comparator means find that the maximum first limit value Ylimit max has been exceeded and/or the minimum first limit value Ylimit min has not been met, this is reported to the first function unit 11 whose first correction means 13 then calculate a corrected manipulated variable Y'S, taking into account the first actual operating parameter X and one of the aforementioned additional actual operating parameters YH, XH, YHH. This corrected manipulated variable Y'S may then be sent as shown here to the comparator means as an input variable for comparison with a first limit value Ylimit max and/or Ylimit min or sent for another comparison and correction procedure, bypassing the comparator means (not shown) or sent directly as an input signal to the frequency converter 4.

From a memory 19, preferably nonvolatile, specific geometry parameters GP for the positive displacement pump assigned to the controller 5 and/or specific delivery fluid parameters FP for the delivery fluid such as, for example, the shear properties of the delivery fluid may be sent to the first limit value specifying unit 12 and/or to the first correction means 13 so that they enter into the calculation of the first limit values Ylimit max, Ylimit min and/or the corrected manipulated variable Y'S within the context of a functional relationship.

In the exemplary embodiment presented here, the corrected manipulated variable Y'S is the maximum or minimum allowed first limit value Ylimit max, Ylimit min, to approximate the manipulated variable YS generated by the regulator as closely as possible. To this extent, the first limit value specifying unit 12 and the first correction means 13 include a shared computer (computer means), because the corrected manipulated variable Y'S in the exemplary embodiment presented here corresponds to a first limit value Ylimit max, Ylimit min. The manipulated variable YS generated by the regulator is overwritten by the corrected manipulated variable Y'S.

In particular when the corrected manipulated variable Y'S should not correspond to the first limit value, the first correction means 13 and the first limit value specifying unit 12 may be implemented as completely separate units, i.e., each with its own computation means, i.e., in separate function units. This is of course also possible for the case presented above, namely when the corrected manipulated variable Y'S should correspond to a first limit value, so that in this case, as shown in FIG. 1, the limit value specifying unit 12 and the correction means 13 are fused together, i.e., they have a shared computation routine.

The exemplary embodiment according to FIG. 1 is described in greater detail below on the basis of exemplary variants of concrete embodiments that are not restricted.

First Example

The first actual operating parameter X corresponds to the actual controlled variable, namely in the exemplary embodiment shown here, a pressure measured in bar. It is assumed that the reference input variable X is a pressure and amounts to at least 20 bar. Likewise, the actual operating parameter X is measured as 20 bar.

Then there is a change in the reference input variable. The reference input variable X changes from 20 bar to 10 bar, for example, due to a corresponding stipulation. This results in a system deviation of W−X=10 bar.

The regulator 6 determines a new manipulated variable YS, namely in this case a voltage value, which is proportional to the rotational speed and is much smaller than that in a previous run and/or in a previous calculation. The first limit value specifying unit 12 calculates a minimum allowed limit value Ylimit min, which represents a minimum allowed rotational speed in the exemplary embodiment presented here. It is desirable to maintain a minimum allowed rotational speed in order to avoid the risk of a lubricant failure if the rotational speed drops below this minimum allowed rotational speed.

The minimum allowed rotational speed, i.e., the minimum allowed limit value Ylimit min is calculated on the basis of the following functional relationship:

$$Ylimit\ \min = n_{allowed} = \left(\frac{X}{k * b * c * v^{a}}\right)^{2}$$

In this functional relationship, Ylimit max corresponds to the minimum allowed limit value. This is a minimum allowed rotational speed (nallowed).

In this case, the first actual operating parameter X is the measured controlled variable, namely here the new actual pressure of 10 bar. The factor $V^{\alpha}$ is another operating parameter, namely a measure of the operating viscosity of the delivery fluid, which is determined by a temperature measurement of the delivery fluid, and/or for the influence of the viscosity on the maximum allowed pressure. This value amounts $10^{0.32}$ for the specific medium in question in the exemplary embodiment shown here. The constant k is the correction value for the lubricating ability of the medium, which amounts to 0.75, for example, for the specific medium.

The constant b is a correction value for the tribological load-bearing capacity of the pump housing. In the exemplary embodiment shown here, this amounts to 1. The pump-specific characteristic value c is a characteristic value for the rotor diameter under a radial load. This amounts to 0.55, for example, in the exemplary embodiment shown here.

The minimum allowed limit value Ylimit min is sent to the first comparator means 10, which compares the manipulated variable YS determined by the regulator 6 with the minimum allowed limit value. Depending on the result of the comparison, either the manipulated variable YS determined by the regulator is transmitted to the frequency converter or a corrected manipulated variable Y'S is calculated by the first correction means, preferably corresponding to the minimum allowed limit value Ylimit min calculated previously (or calculated anew).

Second Example

The first actual operating parameter X corresponds to the actual controlled variable, namely here a pressure. An actual pressure of 20 bar is measured. Based on a corresponding stipulation, the setpoint value of the controlled variable changes, i.e., the reference input variable W changes from 20 bar to 30 bar. At the same time, there is a change in the disturbance variable. It is assumed that the flow resistance increases as a result of a smaller flow-through area, i.e., a smaller flow-through diameter, for example, due to a change in tool.

In practice, this results in the actual operating variable X, i.e., the actual pressure definitely does exceed or would exceed the reference input variable W, because the pump is still operating at an unchanged rotational speed, but in the meantime the flow resistance has increased significantly due to the tool replacement.

The resulting system deviation at the difference forming output then leads to a significant decline, i.e., reduction in the manipulated variable YS. For the case when this is transmitted to the frequency converter 4 as a setpoint stipulation without correction, this would result in a risk to the pump with regard to the allowed pressure at a reduced low rotational speed. To prevent this, the aforementioned manipulated variable YS is compared with the calculated with the minimal limit value Ylimit min (first limit value) which represents the minimum allowed rotational speed. The calculation is made on the basis of the functional relationship described in the first exemplary embodiment. The manipulated variable YS falls below the minimum allowed limit value Ylimit min, i.e., the minimum allowed rotational speed, so a corrected manipulated variable Y'S, which is transmitted instead of the manipulated variable YS to the frequency converter, is then output by the first correction means 13.

The corrected manipulated variable Y'S preferably corresponds to the calculated minimum allowed limit value Ylimit min.

Third Example

The reference input variable W is a volume flow measured in L/min. The first actual operating parameter X is a measured volume flow. It is assumed that the volume flow demand increases during operation. In the example shown here, the reference input variable should double namely from 1500 L/min to 3000 L/min. The regulator 6 determines a manipulated variable YS, namely a rotational speed in this case, from the resulting system deviation W−X. This manipulated variable YS, i.e., the rotational speed preselected by the regulator 6, is compared by the comparator means 10 with a maximum allowed rotational speed, i.e., a first limit value Ylimit max. This maximum allowed rotational speed is determined on the basis of the NPSHavailable, i.e., on the basis of the available NPSH and/or the holding pressure level of the system. In the exemplary embodiment shown here this amounts to 8 m H2O (meters of water column). Then Ylimit max, i.e., the maximum allowed rotational speed, is determined on the basis of the NPSHavailable and another measured actual operating parameter, in this case the viscosity of the medium. This is done on the basis of the diagram shown in FIG. 4, for example, or alternatively, on the basis of a polynomial based on the following calculation principle and stored in a nonvolatile memory:

$NPSH=f$(pump size($da$),spindle angle of slope,viscosity $v$,rotational speed $n$)

which makes it possible to calculate the axial velocity of the medium within the pump, which is applicable for a certain design size and a certain angle of slope based on the pump size as a function of the spindle diameter da and the spindle angle of slope, so that the following relationship is obtained in simplified terms:

$NPSH=f$($vax$ size spindle slope angle,viscosity $v$,rotational speed $n$)

Consequently, it is true that $vax$ allowed size $NPSH=f(v,n)$ so that by means of the relationship $vax=S$*n or $n=vax/S$ ultimately the relationship Ylimit max=$n$allowed size $NPSH=vax$ allowed size $NPSH/S$ can be established.

Thus, an allowed pump rotational speed nallowed size NPSH can be calculated for a pump of a certain pump size with a certain spindle angle of slope and a certain NPSH value.

Figure 4:
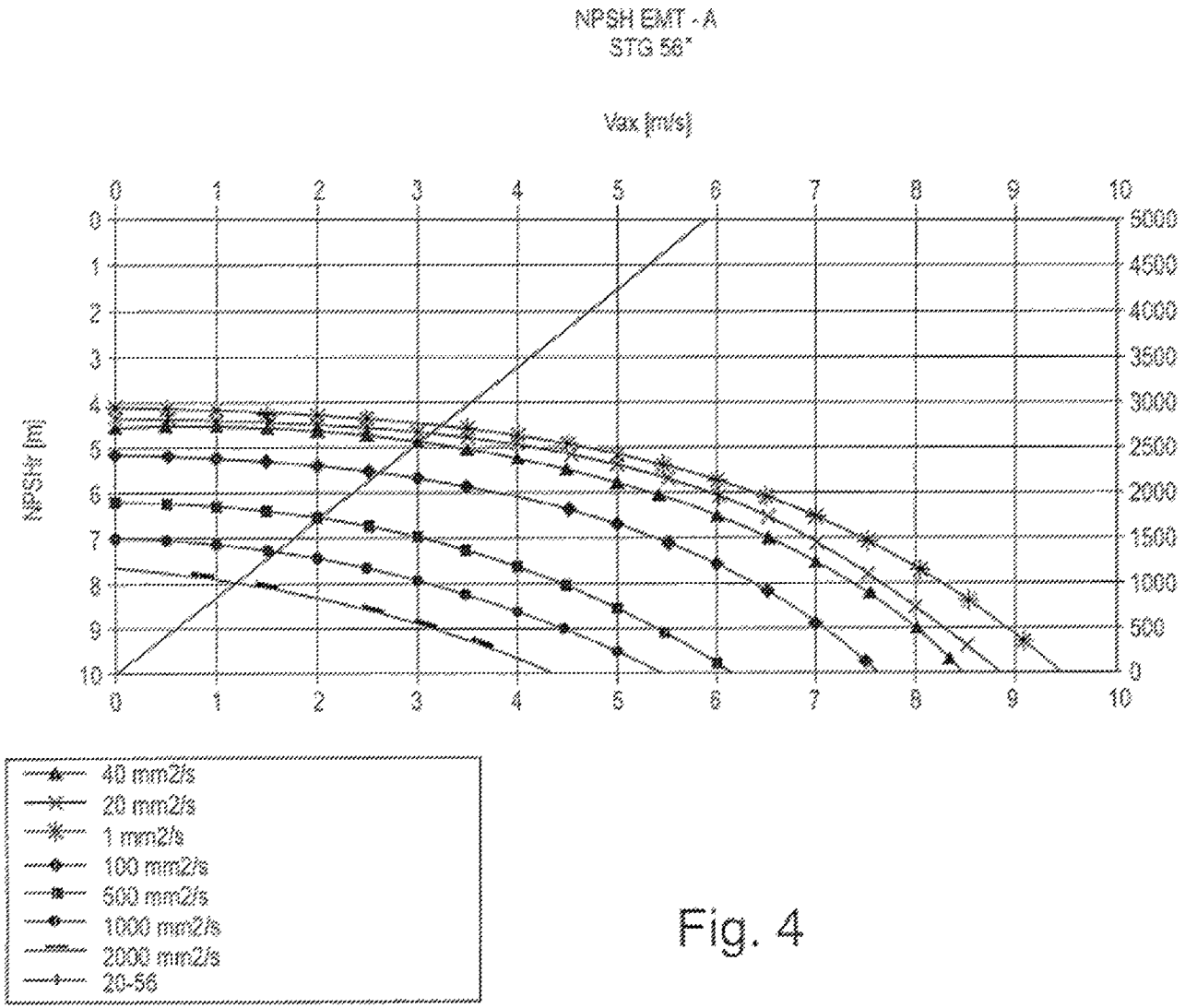
FIG. 4 is an exemplary NPSH diagram.

In the diagram according to FIG. 4, the NPSH is shown on the left vertical ordinate in meters of water column (m H2O). The right ordinate shows the rotational speed in revolutions per minute. The horizontal axis shows the axial velocity of the fluid in m/s. This diagram relates to an exemplary pump having a model size of 20 and an angle of slope of the spindle of 56°. The linear rise of the line characterizes the axial velocity vax of the medium (delivery fluid) as a function of the rotational speed.

To determine the first limit Ylimit max, i.e., the maximum allowed rotational speed, it is necessary to move to the right in the diagram starting from an NPSH of 8 m H2O up to the curve that is characteristic of the measured viscosity of 500 mm2/s. At the point of intersection with this curve, it is necessary to move upward in the diagram up to the linear line. At the point of intersection with this line, the maximum allowed rotational speed, i.e., the first limit value Ylimit max, can thus be read on the ordinate at the right. For the measured viscosity, i.e., the additional actual operating parameter, this amounts to about 3800 revolutions per minute.

As mentioned in the introduction, the reference input variable doubles, i.e., the required volume flow is doubled, which amounts to 3000 l/min from the assumed 1500 l/min, based on the linear relationships of a change in the manipulated variable. Since this manipulated variable YS of 3000 l/min is smaller than the first limit value Ylimit max of approx. 3800 l/min, the manipulated variable YS can be transmitted to the frequency converter 4 as an input variable.

If the reference input variable were not only doubled but instead were tripled, for example, this would yield a manipulated variable of 4500 l/min, which would be larger than the first limit value Ylimit max so that the correction means 13 would exceed the manipulated variable YS stipulated by the regulator 6 by the amount of a corrected manipulated variable Y'S, which would correspond to the first limit value, for example, i.e., 3800 l/min in the present example.

Figure 2:
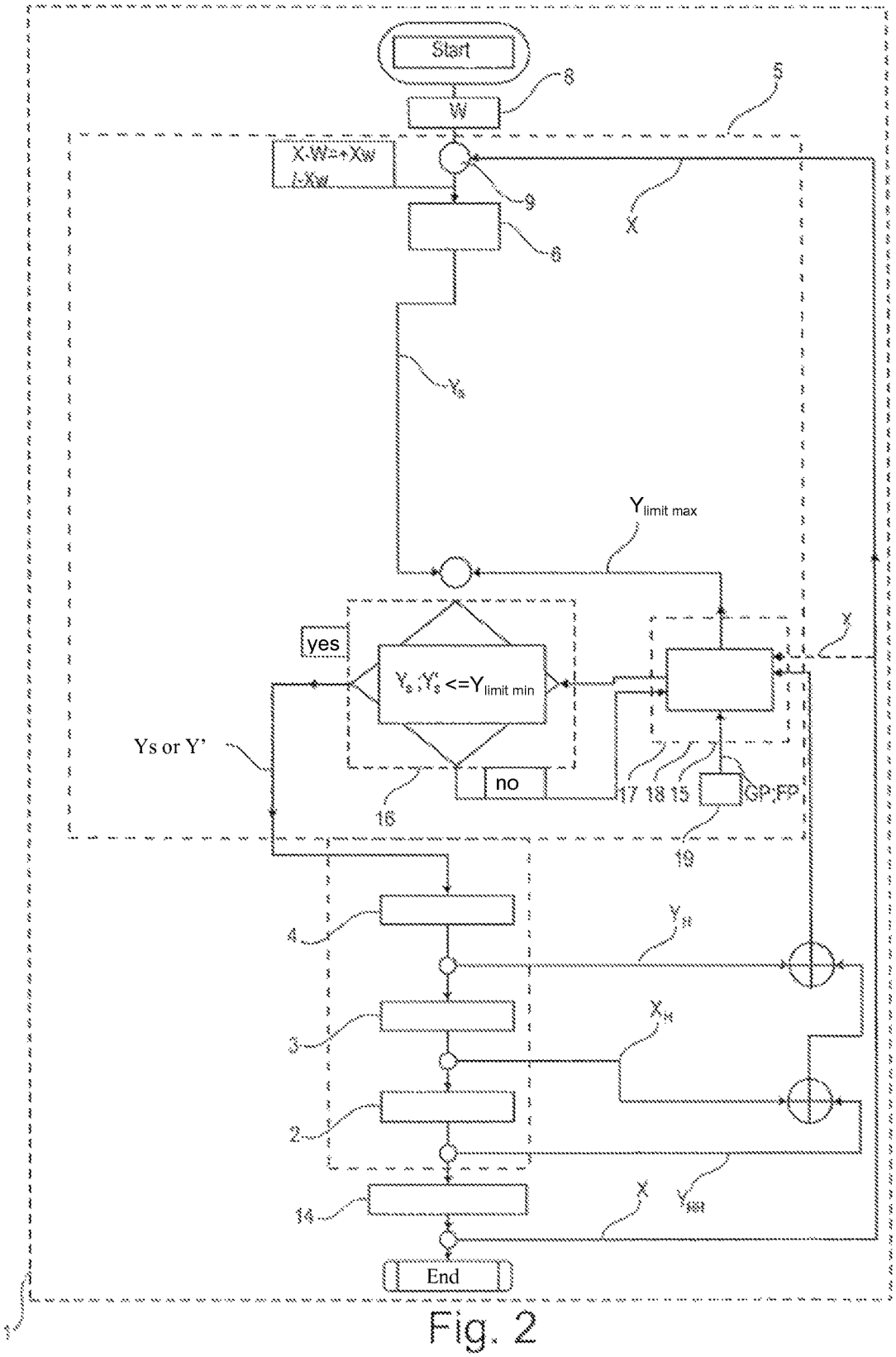
FIG. 2 is an alternative embodiment of a controller configured to compare a manipulated variable generated by a regulator with a (delivery fluid protection) limit value.

Exemplary Embodiment According to FIG. 2

The exemplary embodiment according to FIG. 2 differs from the exemplary embodiment according to FIG. 1 only in that the manipulated variable YS generated by the regulator 6 is not compared with at least one first limit value representing and/or ensuring the positive displacement pump protection but instead is compared with one second limit value that ensures the delivery fluid quality. The exemplary embodiment presented here relates to a second limit value.

The at least one second limit value Ylimit max, Ylimit min ensures that the delivery fluid quality is maintained. In the exemplary embodiment shown here, only a single maximum second limit value Ylimit max is supplied by the second limit value specifying unit 15, whereby as an alternative multiple second limit values, e.g., also a minimal limit value Ylimit min which ensures the quality of the delivery fluid can also be calculated.

At any rate, the second comparator means 16 compare whether the manipulated variable YS generated by the regulator 6 or a corrected manipulated variable already corrected in a previous additional correction procedure not covered here exceeds the second limit value Ylimit min by a certain measure. If the manipulated variable YS is less than or equal to the maximum limit value, then the manipulated variable YS generated by the regulator 6 and/or supplied to the comparator means 16 is made available (calculated) as an input variable to the frequency converter 4.

Otherwise, with the help of second correction means 18, comprising a second function unit 17 in addition to the second limit value specifying unit 15, a corrected manipulated variable Y'S is made available with which the manipulated variable YS is overwritten. To calculate the at least one second limit value Ylimit min, the second limit value specifying unit 15 take into account the first actual operating parameter X on the basis of a functional relationship and also take into account at least one additional (other) actual operating parameter, for example, an auxiliary manipulated variable YH, an auxiliary controlled variable XH and/or a main manipulated variable YHH. For geometry parameters GP of the positive displacement pump and/or delivery fluid parameters FP as well as the vibration to be taken into account additionally in the calculation.

Fourth Example

The fourth example relates to the protection of the medium, i.e., the second limit value is determined so that no negative effect of a quality parameter of the delivery fluid conveyed with the positive displacement pump (delivery medium) results from the manipulated variable.

In the concrete example, there should be assurance that there is no unacceptable shearing in the delivery medium. The maximum allowed shearing rate of the medium therefore enters into the calculation of the second limit value. Again, a rotational speed regulation is to be implemented so that the second limit value corresponds to a maximum allowed rotational speed. This means that the first operating parameter X is a volume flow of the process system. In addition to the medium-specific limits to the maximum allowed shear rate, function factors of the pump enter into the determination of the second limit value, i.e., weight, velocity ratios are taken into account namely the difference in the angular velocity of the rotating positive displacement rotors (spindles) in comparison with the stationary pump housing. The velocity ratios in the gaps are directly proportionally dependent on the pump rotational speed and there is an inverse direct proportional relationship to the size of the function gap, i.e., to the respective current linear shear rate. This function gap is first of all dependent on the pump-specific conditions namely on the prevailing actual radial gap, i.e., the fixed pump rotor radial gap and also the current operating conditions namely the respective current compressive load on the delivery fluid as well as the respective prevailing viscosity of the delivery fluid. The two latter additional actual operating parameters are measured and taken into account in the calculation of the second limit value Ylimit max, i.e., in the calculation of the maximum allowed rotational speed.

Thus, for example, a delivery fluid with a dynamic viscosity $\eta$ of 5 Pas is pumped. This corresponds to a kinematic viscosity v of 5000 mm2/s, such that with an assumed density $\rho$ of 1000 kg/m3 a maximum allowed shear rate Dallowed of 20,000 sec−1 is obtained for the delivery fluid in a certain pump while maintaining the maximum allowed shear stress $\tau$ of 100,000 N/m2. This is characterized by a rotary diameter of Da=70 mm and by a radial gap S=h0, which depends on the differential pressure, yielding a value of 0.021 mm at $\Delta p$=5 bar. This yields a maximum allowed rotational speed, i.e., a second limit value Ylimit max of 191 1/min. As long as the manipulated variable YS preselected by the regulator 6 is below the aforementioned value, the manipulated variable YS can be forwarded directly to the frequency converter 4—otherwise, the manipulated variable YS is overwritten by a manipulated variable Y"S that is corrected and/or limited by second correction means 18.

The example described above is based on the following computation principles:

It follows from $$\text{e.g., } \tau\text{allowed}=D^*\eta \text{ and } \eta=v^*\rho \text{ for Newtonian fluids that}$$

$$D\text{allowed}=\tau\text{allowed}/(v^*p)$$

In addition, it holds that $$n\text{allowed}=W\text{allowed}/(Da^*\pi^*60).$$

By inserting this into $$W\text{allowed}=D\text{allowed}^*S \text{ and/or into } D\text{allowed}=\Delta W\text{allowed}/S$$

and by combining all the constants that occur in k, the maximum allowed rotational speed can be calculated as follows:

$$D\text{allowed}=(Da^*\pi^*n)/(k^*S)\rightarrow n\text{allowed}=(D\text{allowed}^*k^*S)/(Da^*n)$$

The maximum allowed rotational therefore corresponds to the limit value Ylimit max.

For the case when the delivery fluid (medium) to be pumped does not have Newtonian properties, first the Reynolds number in the pump function gap, the shear rate and the resulting representative viscosities must be calculated according to known physical relationships for intrinsically viscous delivery fluids. In this way, the allowed relationships for these fluids can be monitored and maintained in the same way as in the case of Newtonian delivery fluids.

Figure 3:
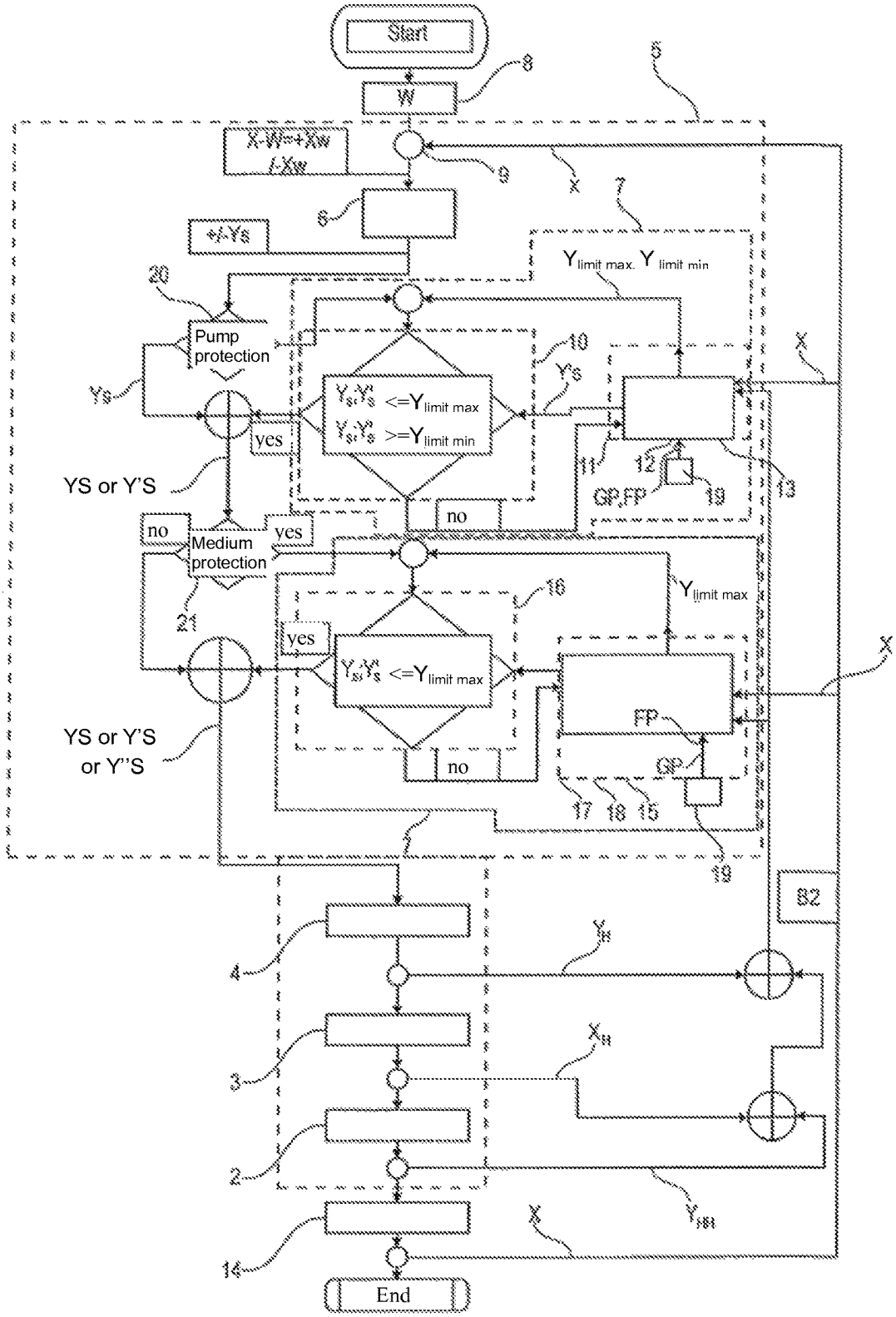
FIG. 3 is another embodiment a controller in which the manipulated variable generated by the regulator is to be compared with a first limit value and/or a second limit value and can optionally be corrected.

Exemplary Embodiment According to FIG. 3

The exemplary embodiment according to FIG. 3 negates the exemplary embodiments according to FIG. 1 and FIG. 2, i.e., the controller 5 are designed so that the manipulated variable YS output by the regulator 6 can be compared with at least one first limit value (pump protection limit value) as well as with at least one second limit value (medium protection limit value). In the exemplary embodiment presented according to FIG. 3, the manipulated variable YS generated by the regulator 6 is first compared with a first limit value and then with a second limit value, but the reverse order may of course also be implemented, i.e., by comparing the manipulated variable first with a second limit value and then with a first limit value.

It is characteristic of the exemplary embodiment according to FIG. 3 that the output value of the first comparison forms the input variable for the second comparison where the output variable of the first comparison cannot be the corrected manipulated variable YS, namely when there is nothing going beyond the limit value in the first comparison and thus YS is not corrected, or alternatively, when it is a manipulated variable Y'S corrected by the first comparator means 10.

YS or Y'S is then the input variable for the second comparator means 16. If no correction is performed here, the input value for the second comparison YS or Y'S is sent to the frequency converter 4 or in the case of a correction the corrected manipulated variable Y"S is sent to the frequency converter.

In the exemplary embodiment presented here, the first and second decision means 20, 21 are provided. These decision means determine whether a pump protection comparison and/or a medium protection comparison is to be performed. The respective decision can be predefined in the software, for example, so that as an alternative the user need only perform a pump protection comparison or a medium protection comparison or may perform both comparison operations.

Figure 5:
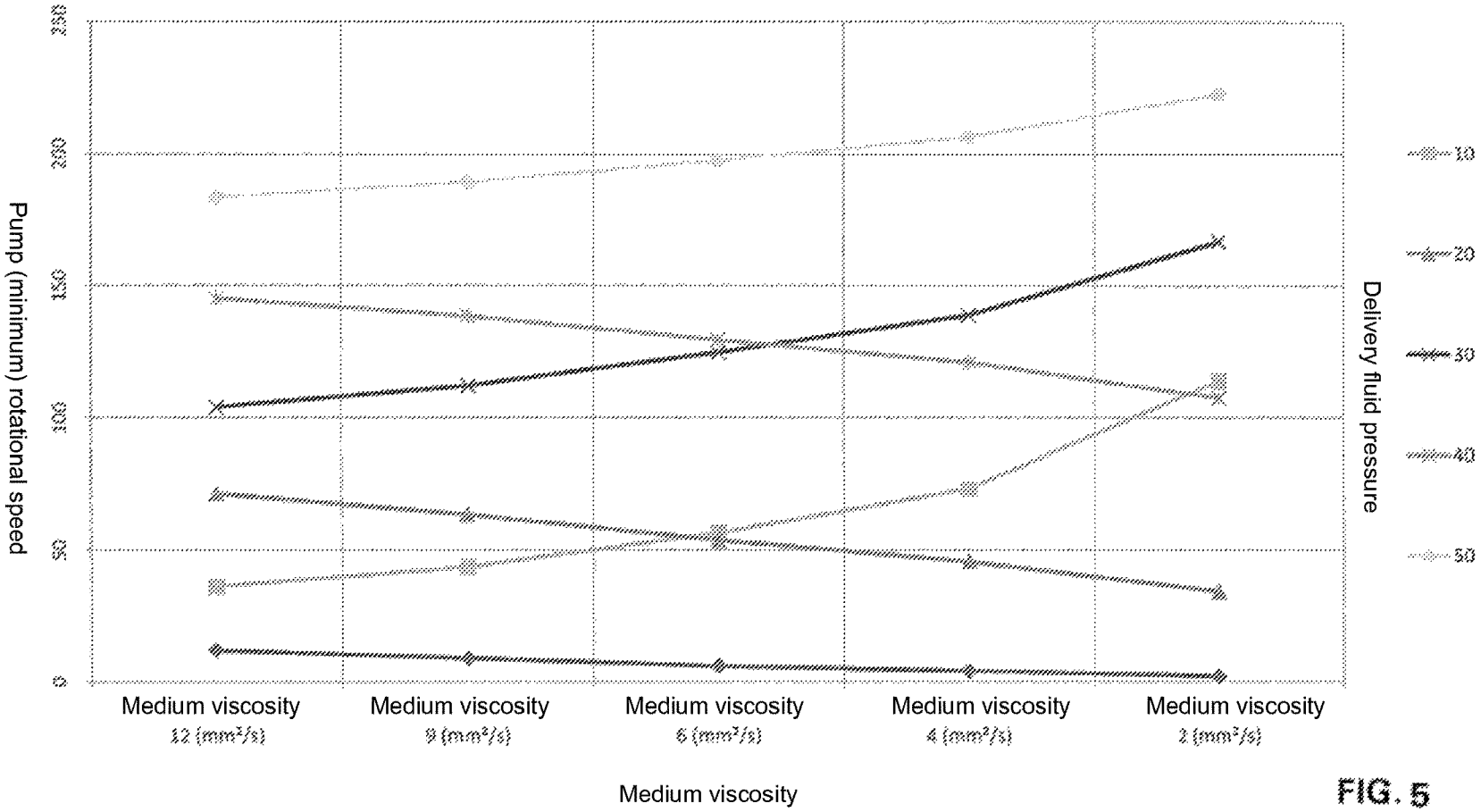
FIG. 5 is a diagram illustrating the physical relationship between the delivery fluid pressure, measured at the pressure connection of the pump, the delivery fluid viscosity (medium viscosity) and the pump rotational speed, namely here a minimum rotational speed of the pump.

Exemplary Embodiment According to FIG. 5

This exemplary embodiment is a protected exemplary embodiment for implementation of pump protection. The manipulated variable is a rotational speed signal for the pump, where the pump rotational speed is plotted on the left ordinate in the diagram. The delivery pressure measured at the pressure connection of the pump enters into the calculation of the first limit value as the first actual operating parameter, with the delivery fluid pressure being plotted on the right ordinate. The delivery fluid viscosity (medium viscosity) enters into the calculation of the first limit value as an additional actual operating parameter, wherein the medium viscosity is plotted on the horizontal lower axis. Alternatively, the delivery fluid volume flow and/or the pump rotational speed or the delivery fluid pressure is considered here as the reference input variables. In the concrete exemplary embodiment, it is assumed that the delivery fluid pressure is the reference input variable.

In the example shown here, it is assumed that the delivery fluid viscosity (medium viscosity) drops from 12 mm2/s to 9 mm2/s, to 6 mm2/s, to 4 mm2/s and then (incrementally) to 2 mm2/s because of a corresponding change in medium. The delivery fluid volume flow may fluctuate. The reference input variable, i.e., the process pressure (delivery fluid pressure) should initially be kept at 10 bar, then at 20 bar, etc., i.e., it should increase incrementally by 10 bar at a time up to max. 50 bar.

In other words, the reference input variable changes incrementally from 10 bar initially to 50 bar. The regular outputs a manipulated variable (YS) as a function of the reference input variable (W). The first limit value specifying unit calculate a first limit value, which in the present case is a minimum rotational speed Ylimit min as a function of the first actual operating parameter, which here is the delivery fluid pressure and in addition, the actual operating parameter which here is the medium viscosity such that in the concrete exemplary embodiment the medium viscosity is determined indirectly based on the delivery fluid temperature. In the present exemplary embodiment, failure to conform to the first limit value, i.e., the minimum rotational speed would have resulted in a defect status of the positive displacement pump. The comparator means in the concrete exemplary embodiment compare the manipulated variable preselected by the regulator, i.e., a rotational speed signal, with the first limit value calculated by the first limit value specifying unit. If the manipulated variable in the exemplary embodiment presented here is above this first limit value, then the manipulated variable is forwarded to the frequency converter as an input signal. If the manipulated variable falls below the first limit value, then in the exemplary embodiment presented here a corrected manipulated variable is ascertained and/or determined as the input variable and is forwarded to the frequency converter where the first limit value determined by the limit value specifying unit is forwarded as a corrected manipulated variable from the first correction means in the exemplary embodiment presented here.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are in the tended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Thus, the claims set forth below should be construed in view of the full breadth and spirit of the present disclosure as described herein.

The invention claimed is:

1. A controller for controlling a frequency converter of a positive displacement pump motor of a positive displacement pump, comprising:

a logic unit configured to execute the following instructions:

generate a manipulated variable (YS) for the frequency converter as a function of a reference input variable (W) and a first actual operating parameter (X), the manipulated variable (YS) generated to control, at least in part, output of the frequency converter;

determine at least one first limit value having a first maximum limit and a first minimum limit as a function of the first actual operating parameter (X), and at least one additional actual operating parameter (XH, YH, YHH), such that in response to exceeding the first maximum limit or falling below the first minimum limit of the at least one first limit value, a defect state of the positive displacement pump is determined;

compare the manipulated variable (YS), or a first previously corrected manipulated variable (Y'S, Y"S), or a comparative value with the first maximum limit and the first minimum limit of the at least one first limit value, wherein when the manipulated variable (YS) is determined to exceed the first maximum limit or fall below the first minimum limit of the at least one first limit value, the defect state of the positive displacement pump is determined;

output a first corrected manipulated variable (Y'S, Y"S) in response to exceeding the first maximum limit or falling below the first minimum limit of the at least one first limit value by a predetermined amount, the first corrected manipulated variable (Y'S, Y"S) generated to control, at least in part, output of the frequency converter;

determine at least one second limit value having a second maximum limit and a second minimum limit as a function of the first actual operating parameter (X) and the at least one additional actual operating parameter (XH, YH, YHH), such that in response to exceeding the second maximum limit or falling below the second minimum limit of the at least one second limit value, a negative effect on a quality parameter of delivery fluid conveyed by the positive displacement pump is determined;

compare the manipulated variable (YS), or the first corrected manipulated variable (Y'S, Y"S), or a second previously corrected manipulated variable (Y'S, Y"S), or the comparative value with the second maximum limit and the second minimum limit of the at least one second limit value, wherein when the manipulated variable (YS) is determined to exceed the second maximum limit or fall below the second minimum limit of the at least one second limit value, the negative effect on the quality parameter of delivery fluid conveyed by the positive displacement pump is determined; and output a second corrected manipulated variable (Y'S, Y"S) in response to exceeding the second maximum limit or falling below the second minimum limit of the at least one second limit value by a predetermined amount, the second corrected manipulated variable (Y'S, Y"S) generated to control, at least in part, output of the frequency converter;

wherein the at least one first limit value is dynamically determinable subject to change during operation of the positive displacement pump as a function of the first actual operating parameter (X) and the at least one additional actual operating parameter (XH, YH, YHH).

2. The controller according to claim 1, wherein the first actual operating parameter is a measured actual controlled variable (X) comprising an actual pressure, an actual pressure difference or an actual volume flow of the delivery fluid.

3. The controller according to claim 1, wherein the at least one additional actual operating parameter (XH, YH, YHH) is at least one of the following:

a measured actual controlled variable (X) comprising an actual pressure, an actual pressure difference or an actual volume flow of the delivery fluid;

a measured auxiliary manipulated variable (YH) calculated on the basis of the actual or measured value of a rotational frequency setpoint value of the frequency converter or a torque setpoint value of the frequency converter;

a measured auxiliary controlled variable (XH) calculated on the basis of a rotational speed of the positive displacement pump motor or a torque of the positive displacement pump motor;

a measured delivery fluid temperature or a storage temperature of the positive displacement pump;

a measured vibration value or a measured or calculated delivery fluid viscosity; and a measured leakage rate.

4. The controller according to claim 1, wherein the logic unit determines the comparative value on the basis of the functional relationship from the manipulated variable (YS) or from the first or second corrected manipulated variable (Y'S, Y"S) or from the first actual operating parameter (X) and the at least one additional actual operating parameter (XH, YH, YHH).

5. The controller according to claim 4, wherein at least one geometry parameter (GP) is accounted for in determining the comparative value, the geometry parameter being specific to the positive displacement pump assigned to the controller, the geometry parameter stored in a memory for determining the comparative value within the context of the functional relationship, or to take into account the shear properties of the delivery fluid from a delivery fluid parameter (FP) stored in the memory.

6. The controller according to claim 1, wherein the logic unit is configured to further execute:

determining at least one of the at least one first limit value and the at least one second limit value as a function of a gap width or a spindle diameter assigned to the controller and stored in a memory, or to determine the at least one of the at least one first limit value and the at least one second limit value as a function of a delivery fluid parameter (FP) stored in the memory; and determining the first or second corrected manipulated variable (Y'S, Y"S) as a function of the gap width or the spindle diameter, or as a function of the delivery fluid parameter (FP) stored in the memory, the delivery fluid parameter (FP) comprising shear properties of the delivery fluid.

7. The controller according to claim 1, wherein the logic unit is configured to further execute:

determining at least one of the at least one first limit value and the at least one second limit value as a function of a minimum or maximum shear rate in the positive displacement pump, which is stored in a memory and is specific for the positive displacement pump assigned to the controller, or as a function of at least one of an actual shear rate, and determining the first or second corrected manipulated variable (Y'S, Y"S) as a function of at least one shear rate in the positive displacement pump, which is stored in the memory, and is specific for the positive displacement pump assigned to the controller, or as a function of actual shear rate.

8. The controller according to claim 1, wherein the controller has at least one input for the first actual operating parameter (X) and has multiple inputs for the at least one additional actual operating parameter (XH, YH, YHH).

9. The controller according to claim 1, wherein in a nonvolatile memory comprising an EEPROM, different system parameter data records for different positive displacement pumps or different delivery fluid parameters (FP) are stored for manually selection via a selection menu.

10. The controller according to claim 1, wherein the logic unit is configured to determine or to signal a maintenance need of the positive displacement pump as a function of at least one of the first actual operating parameter (X), the at least one additional actual operating parameter (XH, YH, YHH), and a parameter that is specific for the positive displacement pump assigned to the controller.

11. The controller according to claim 1, wherein the controller is configured to communicate via a CAN bus system.

12. The controller according to claim 1, wherein the controller has a memory configured and controlled to save at least one of the first actual operating parameter (X), the at least one additional actual operating parameter (XH, YH, YHH), the reference input variable (W), comparative value, the at least one first limit value, and the at least one second limit value with a time stamp.

13. The controller according to claim 1, further including a key for configuration of the controller.

14. The controller according to claim 1, further including at least one of a display and an LED lamp.

15. A positive displacement pump system, comprising a positive displacement pump, a positive displacement pump motor for driving the positive displacement pump, and the controller and frequency converter of claim 1, wherein reference input variable specifying units are assigned to the controller for supplying the controller with the reference input variable (W).

16. The system according to claim 15, wherein the reference input variable specifying units are configured for at least one of monitoring, controlling and regulating a plurality of system units, the system units comprising positive displacement pumps.

17. The system according to claim 15, wherein multiple positive displacement pumps are provided with respective ones of said controllers.

18. The system according to claim 15, wherein the controllers are configured to communicate with at least one of a process control room and multiple controllers with one another over a CAN bus system.

19. The system according to claim 15, wherein the controllers have a signal-conducting connection to at least one sensor for receiving the first actual operating parameter (X)

or the at least one additional measured actual operating parameter (XH, YH, YHH); and the controllers have a signal-conducting connection to the frequency converter for receiving the first actual operating parameter (X) or the at least one additional measured actual operating parameter (XH, YH, YHH), the at least one additional measured actual operating parameter comprising a positive displacement pump motor rotational speed or a rotational frequency setpoint value of the frequency converter or a torque setpoint value of the frequency converter.

20. The controller of claim 1, wherein the logic unit is configured to further execute:

outputting the first maximum limit or the first minimum limit of the at least one first limit value in response to exceeding the first maximum limit or falling below the first minimum limit of the at least one first limit value.

21. The controller of claim 1, wherein the logic unit is configured to further execute:

outputting the second maximum limit or the second minimum limit of at least one the second limit value in response to exceeding the second maximum limit or falling below the second minimum limit of the at least one second limit value.

22. A method for controlling a frequency converter of a positive displacement pump motor of a positive displacement pump, comprising:

generating a manipulated variable (YS) for the frequency converter of the positive displacement pump motor as a function of a reference input variable (W) and of a first actual operating parameter (X), the manipulated variable (YS) generated to control, at least in part, output of the frequency converter, determining by a logic unit a first limit value having a first maximum limit and a first minimum limit as a function of the first actual operating parameter (X), and at least one additional actual operating parameter (XH, YH, YHH), such that, in response to exceeding the first maximum limit or falling below the first minimum limit of the at least one first limit value, a defect state of the positive displacement pump is determined, comparing by the logic unit the manipulated variable (YS) or a first previously corrected manipulated variable (Y'S, Y"S), or a comparative value with the first maximum limit and the first minimum limit of the at least one first limit value, wherein when the manipulated variable (YS) is determined to exceed the first maximum limit or fall below the first minimum limit of the at least one first limit value, the defect state of the positive displacement pump is determined;

outputting by the logic unit a first corrected manipulated variable (Y'S, Y"S) in response to exceeding the first maximum limit or falling below the first minimum limit of the at least one first limit value by a predetermined amount, the first corrected manipulated variable (Y'S, Y"S) generated to control, at least in part, output of the frequency converter, determining by the logic unit at least one second limit value having a second maximum limit and a second minimum limit as a function of the first actual operating parameter (X) and the at least one additional actual operating parameter (XH, YH, YHH), such that in response to exceeding the second maximum limit or falling below the second minimum limit of the at least one second limit value, a negative effect on a quality parameter of delivery fluid conveyed by the positive displacement pump is determined, comparing by the logic unit a manipulated variable (YS), or the first corrected manipulated variable (Y'S, Y"S), or a previously second corrected manipulated variable (Y'S, Y"S), or the comparative value with the second maximum limit and the second minimum limit of the at least one second limit value, wherein when the manipulated variable (YS) is determined to exceed the second maximum limit or fall below the second minimum limit of the at least one second limit value, the negative effect on the quality parameter of delivery fluid conveyed by the positive displacement pump is determined; and outputting by the logic unit a second corrected manipulated variable (Y'S, Y"S) in response to exceeding the second maximum limit or falling below the second minimum limit of the at least one second limit value by a predetermined amount, the second corrected manipulated variable (Y'S, Y"S) generated to control, at least in part, output of the frequency converter;

wherein the at least one first limit value is dynamically determinable subject to change during operation of the positive displacement pump as a function of the first actual operating parameter (X) and the at least one additional actual operating parameter (XH, YH, YHH).

* * * * *